US011136693B2

(12) United States Patent
Tawfick et al.

(10) Patent No.: US 11,136,693 B2
(45) Date of Patent: Oct. 5, 2021

(54) FIBER-BASED DEVICE HAVING A RECONFIGURABLE GEOMETRY

(71) Applicant: The Board of Trustees of the University of Illinois, Urbana, IL (US)

(72) Inventors: Sameh H. Tawfick, Champaign, IL (US); Dongwoo Shin, Berkeley, CA (US)

(73) Assignee: THE BOARD OF TRUSTEES OF THE UNIVERSITY OF ILLINOIS, Urbana, IL (US)

( * ) Notice: Subject to any disclaimer, the term of this patent is extended or adjusted under 35 U.S.C. 154(b) by 369 days.

(21) Appl. No.: 16/138,196

(22) Filed: Sep. 21, 2018

(65) Prior Publication Data

US 2019/0093259 A1 Mar. 28, 2019

Related U.S. Application Data

(60) Provisional application No. 62/561,917, filed on Sep. 22, 2017.

(51) Int. Cl.

| | |
|---|---|
| ***D01D 10/06*** | (2006.01) |
| ***D01D 11/02*** | (2006.01) |
| ***D01D 5/253*** | (2006.01) |

(52) U.S. Cl.

CPC ..... *D01D 10/06* (2013.01); *D01D 5/253* (2013.01); *D01D 11/02* (2013.01); *D10B 2101/08* (2013.01); *D10B 2101/12* (2013.01); *D10B 2101/20* (2013.01); *D10B 2401/061* (2013.01); *D10B 2401/062* (2013.01)

(58) Field of Classification Search

None

See application file for complete search history.

(56) References Cited

U.S. PATENT DOCUMENTS

2003/0136746 A1* 7/2003 Behmann ..... B01D 63/026 210/771

OTHER PUBLICATIONS

Bernhard, Jennifer T., "Reconfigurable Antennas," *Synthesis Lectures on Antennas* #4, Morgan & Claypool Publishers (2007) pp. 1-65.

Bhattacharyya, P.K., "On the Capillary Phenomena of Jets," *MIT-ISN, HML Reading Group*, Jun. 29, 2007 (http://web.mit.edu/nnf/education/Summer_Study_2007/Jets2.pdf) 11 pp.

(Continued)

*Primary Examiner* — Monica A Huson

(74) *Attorney, Agent, or Firm* — Crowell & Moring LLP

(57) ABSTRACT

A fiber-based device having a reconfigurable geometry comprises an array of hair-like fibers spaced apart on a substrate, where each hair-like fiber comprises a free end extending away from the substrate and a secured end attached to the substrate. The array has a first bundled configuration where the free ends of the hair-like fibers are drawn together into a bundle having a first cross-sectional shape, and a second bundled configuration where the free ends of the hair-like fibers are drawn together into a bundle having a second cross-sectional shape. The array is reconfigurable from the first bundled configuration to the second bundled configuration by exposure to a liquid and then removal of the liquid at a predetermined rate.

22 Claims, 6 Drawing Sheets

(56) References Cited

OTHER PUBLICATIONS

Bhushan, Bharat, "Biomimetics:lessons from nature—an overview," *Philosophical Transactions of the Royal Society A*, 367 (2009) pp. 1445-1486.
Bico, Jose et al., "Elastocapillary coalescence in wet hair," *Nature*, 432, 7018 (2004) p. 690.
Brewer, C.A. et al, "Functional interaction between leaf trichomes, leaf wettability and the optical properties of water droplets," *Plant, Cell and Environment*, 14 (1991) pp. 955-962.
Chiodi F. et al., "Piercing an interface with a brush: Collaborative stiffening," EPL, 90, 44006 (2010) pp. 1-6.
DeVolder, Michael et al., "Diverse 3D Microarchitectures Made by Capillary Forming of Carbon Nanotubes," *Advanced Materials*, 22 (2010) pp. 4384-4389.
Duprat, C., et al., "Wetting of flexible fibre arrays," *Nature*, 482, 7386 (2012) pp. 510-513.
Evans, Humberto et al., "Engineered bio-inspired coating for passive flow control," *PNAS*, 115, 6 (2018) pp. 1210-1214.
Fu, Haoran et al., "Morphable 3D mesostructures and microelectronic devices by multistable buckling mechanics." *Nature Materials*, 17 (2018) pp. 268-276.
Futaba, Don et al., "Shape-engineerable and highly densely packed single-walled carbon nanotubes and their application as supercapacitor electrodes," *Nature Materials*, 5 (2006) pp. 987-994.
Grinthal A. et al., "Steering nanofibers: An integrative approach to bio-inspired fiber fabrication and assembly," *NANO Today*, 7 (2011) pp. 35-52.
Hadjittofis, Andreas et al., "Evaporation effects in elastocapillary aggregation," *J. Fluid Mech.*, 792 (2016) pp. 168-185.
Hartl, D. et al., "A liquid metal-based structurally embedded vascular antenna: I. Concept and multiphysical modeling," *Smart Materials and Structure*, 26, 025001 (2017) 15 pp.
Kim, Ho-Young et al., "Capillary rise between elastic sheets," *J. Fluid Mech.*, 548 (2006) pp. 141-150.
Lendlein, Andreas et al., "Light-induced shape-memory polymers," *Nature*, 434, 7035 (2005) pp. 879-882.
Leong, Timothy et al., "Three-Dimensional Fabrication at Small Size Scales," *Small*, 6:7 (2010) pp. 792-806.
Nasto, Alice et al., "Air entrainment in hairy surfaces," *Physical Review Fluids*, 1, 033905 (2016) 8 pp.
Pety, Stephen et al., "Carbon fiber composites with 2D microvascular networks for battery cooling," *International Journal of Heat and Mass Transfer*, 115 (2017) pp. 513-522.
Pokroy, Boaz et al., "Self-Organization of a Mesoscale Bristle into Ordered, Hierarchical Helical Assemblies," *Science*, 323, 5911 (2009) pp. 237-240.
Quaranta, Greta et al., "Hydrodynamics Versus Intracellular Coupling in the Synchronization of Eukaryotic Flagella," *Physical Review Letters*, 115, 238101 (2015) 5 pp.
Singh, Kiran et al., "A fluid-mechanical model of elastocapillary coalescence," *J. Fluid Mech.*, 745 (2014) pp. 621-646.
Taroni, Michele et al., "Multiple equilibria in a simple elastocapillary system," *J. Fluid Mech.*, 712 (2012) pp. 273-294.
Tawfick, Sameh et al., "Mechanics of Capillary Forming of Aligned Carbon Nanotube Assemblies," *Langmuir*, 29 (2013) pp. 5190-5198.
Tawfick, Sameh et al., "Structurally Programmed Capillary Folding of Carbon Nanotube Assemblies," *Langmuir*, 27 (2011) pp. 6389-6394.
Tawfick, Sameh et al., "Three-dimensional lithography by elastocapillary engineering of filamentary materials," *MRS Bulletin*, 41 (2016) pp. 108-114.
Toohey, Kathleen et al., "Self-healing materials with microvascular networks," *Nature Materials*, 6 (2007) pp. 581-585.
Wei, Z. et al., "Continuum dynamics of elastocapillary coalescence and arrest," EPL, 106, 14002 (2014) 6 pp.
Wei, Z. et al.,"Elastocapillary coalescence of plates and pillars," *Proc. R. Soc. A*, 471, 20140593 (2018) 17 pp.
White, S.R. et al., "Restoration of Large Damage volumes in Polymers," *Science*, 344, 6184 (2014) pp. 620-623.

* cited by examiner

FIBER-BASED DEVICE HAVING A RECONFIGURABLE GEOMETRY

RELATED APPLICATION

The present patent document claims the benefit of priority under 35 U.S.C. § 119(e) to U.S. Provisional Patent Application No. 62/561,917, filed Sep. 22, 2017, which is hereby incorporated by reference in its entirety.

TECHNICAL FIELD

The present disclosure is related generally to microscale or hair-like fibers and more particularly to a reconfigurable device formed from an array of such fibers.

BACKGROUND

Hair-like fibers of different scales and packing densities are ubiquitous in nature. Many plants, insects and animals use hair, fur or fins for a variety of critical purposes including defense, temperature regulation, optical appearance, mechanical protection, acoustic and chemical signaling. For example, the tarsi ("feet") of beetles are lined with adhesive bristles that can exhibit bundling and aggregation when exposed to oil secretions, which leads to increased foot adhesion and improved self-defense against predators. Also, the hairy leaves of the silver tree change in morphology as a function of moisture; during hot, dry weather, the hair lies down parallel to the leaves to protect them from drying out by reflecting radiation and impeding water evaporation, while in damp weather, the hairs bundle and stay vertical to allow for better air circulation.

Given the functionality of hair, bristles, and fur in nature, it would be advantageous to manipulate hair-like fibers in manufactured devices by exploiting the phenomenon of elastocapillarity—the balance between the bending energy of a hair-like fiber and the capillary forces of a liquid.

BRIEF SUMMARY

A fiber-based device having a reconfigurable geometry comprises an array of hair-like fibers spaced apart on a substrate, where each hair-like fiber comprises a free end extending away from the substrate and a secured end attached to the substrate. The array has a first bundled configuration where the free ends of the hair-like fibers are drawn together into a bundle having a first cross-sectional shape, and a second bundled configuration where the free ends of the hair-like fibers are drawn together into a bundle having a second cross-sectional shape. The array is reconfigurable from the first bundled configuration to the second bundled configuration by exposure to a liquid and then removal of the liquid at a predetermined rate.

A method of reconfiguring the geometry of a fiber-based device comprises providing an array of hair-like fibers spaced apart on a substrate, where each hair-like fiber comprises a free end extending away from the substrate and a secured end attached to the substrate. The array of hair-like fibers is exposed to a liquid, and the liquid is removed at a predetermined removal rate. As the liquid is removed, the free ends of the hair-like fibers are drawn into a bundle having a cross-sectional shape dependent on the removal rate of the liquid, and a bundled configuration of the array is formed.

DETAILED DESCRIPTION

Described herein is a fiber-based device having a reconfigurable architecture that may be useful in applications ranging from tunable antennas to flow-altering airfoils.

Figure 1A:
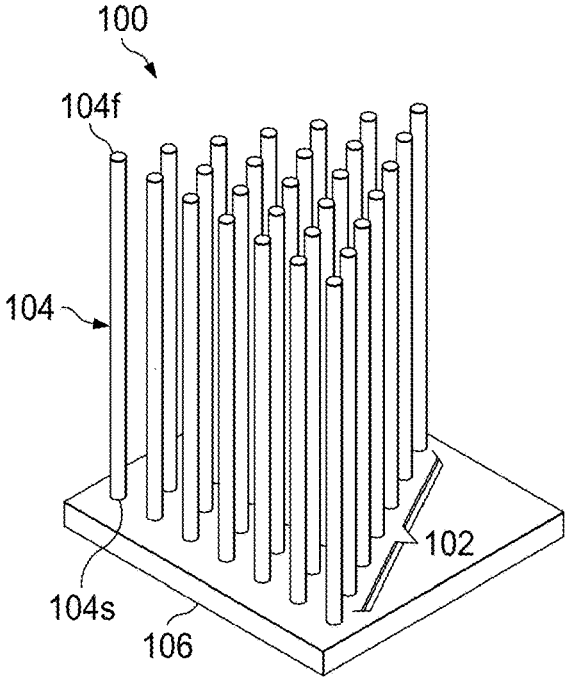
FIG. 1A shows a fiber-based device comprising an array of hair-like fibers spaced apart on a substrate, where free ends of the hair-like fibers are unbundled.

Referring to FIG. 1A, the device 100 includes an array 102 of hair-like fibers 104 spaced apart on a substrate 106. Each hair-like fiber 104 has a free end **104*f* extending away from the substrate 106 and a secured end 104*s* attached to the substrate 106. The hair-like fibers 104 may be bonded to (e.g., physically and/or chemically bonded) or integrally formed with the substrate 106 at the secured ends 104*s*. The arrangement of the secured ends 104*s* defines the shape of the array 102 on the substrate 106. In this example, the array 102 has the shape of a triangle, although the one- or two-dimensional array can have any desired shape (e.g., line, triangle, circle, square, rectangle, parallelogram, pentagon, hexagon, octagon, irregular shape, etc.). Typically, the hair-like fibers 104 have sufficient stiffness to extend away from the substrate 106 in a normal direction, but also sufficient flexibility for the free ends 104*f*** to self-assemble together in various configurations, as described below.

Figure 1B:
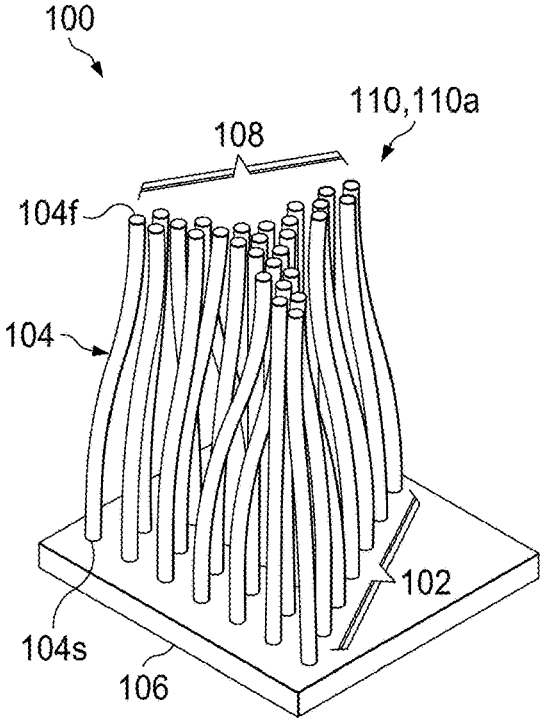
FIG. 1B shows the fiber-based device of FIG. 1A in a first bundled configuration, where the free ends of the hair-like fibers are drawn together into a bundle having a first cross-sectional shape, which in this example is a concave hexagon.
Figure 1C:
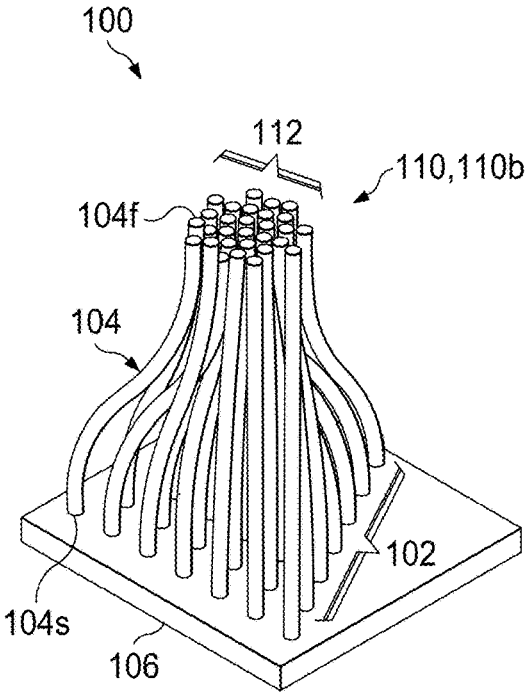
FIG. 1C shows the fiber-based device of FIGS. 1A and 1B in a second bundled configuration, where the free ends of the hair-like fibers are drawn together into a bundle having a second cross-sectional shape, which in this example is a circular shape.

An essential feature of the inventive device 100 is that the array 102 of hair-like fibers 104 is reconfigurable from a first bundled configuration 108, as shown for example in FIG. 1B, to a second bundled configuration 112, as shown for example in FIG. 1C (or from the second bundled configuration 112 to the first bundled configuration 108) by exposure to and then removal of a liquid at a predetermined removal rate. Thus, the fiber-based device 100 may exploit the phenomenon of elastocapillarity to effect shape reconfiguration.

Referring to FIG. 1B, in the first bundled configuration 108 of the array 106, the free ends 104*f* of the hair-like fibers 104 are drawn together into a bundle 110 having a first cross-sectional shape 110*a*, which in this example is a concave hexagon. The cross-sectional shape (e.g., first cross-sectional shape) of the bundle 110 may be understood to be the two-dimensional shape observable at the free ends 104*f* of the hair-like fibers 104. Also, the phrase "drawn together into a bundle" may be understood to have the same or a similar meaning as "bundled together" or "self-assembled."

Referring to FIG. 1C, in the second bundled configuration 112 of the array 106, the free ends 104*f* of the hair-like fibers 104 are drawn together into a bundle 110 having a second cross-sectional shape 110*b*, which in this example is a circular shape or circle. As would be recognized by the skilled artisan, the bundle 110 is not limited to the geometries shown in FIGS. 1B and 1C.

FIGS. 2A-2D illustrate the inventive method of reconfiguring a fiber-based device, which may be referred to as polymorphic texture reconfiguration or polymorphic self-assembly.

Figure 2B:
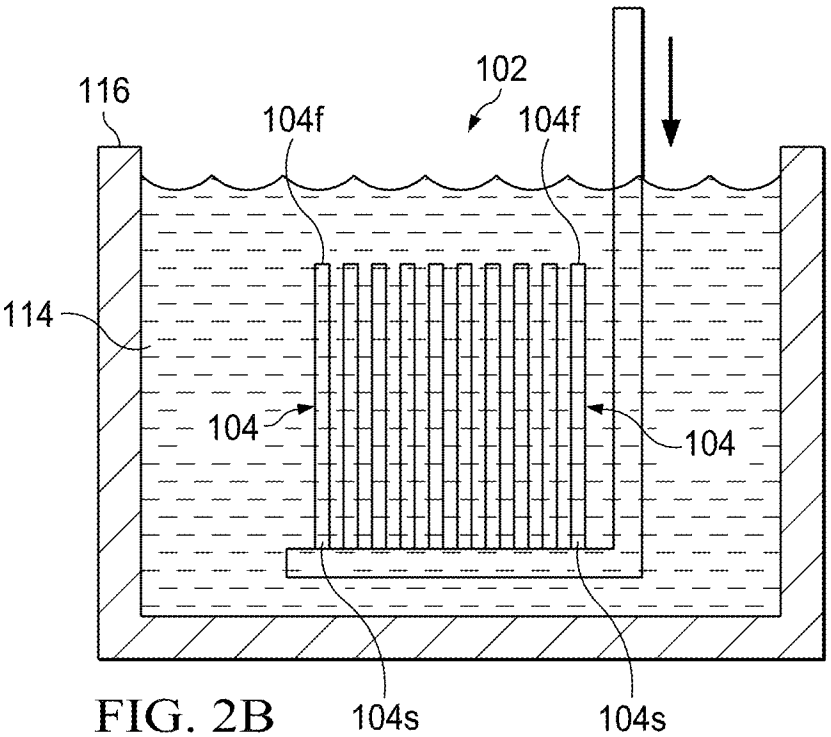
FIGS. 2A through 2D are schematics showing a method of reconfiguring a fiber-based device, which may be described as polymorphic texture reconfiguration or polymorphic self-assembly.
Figure 2A:
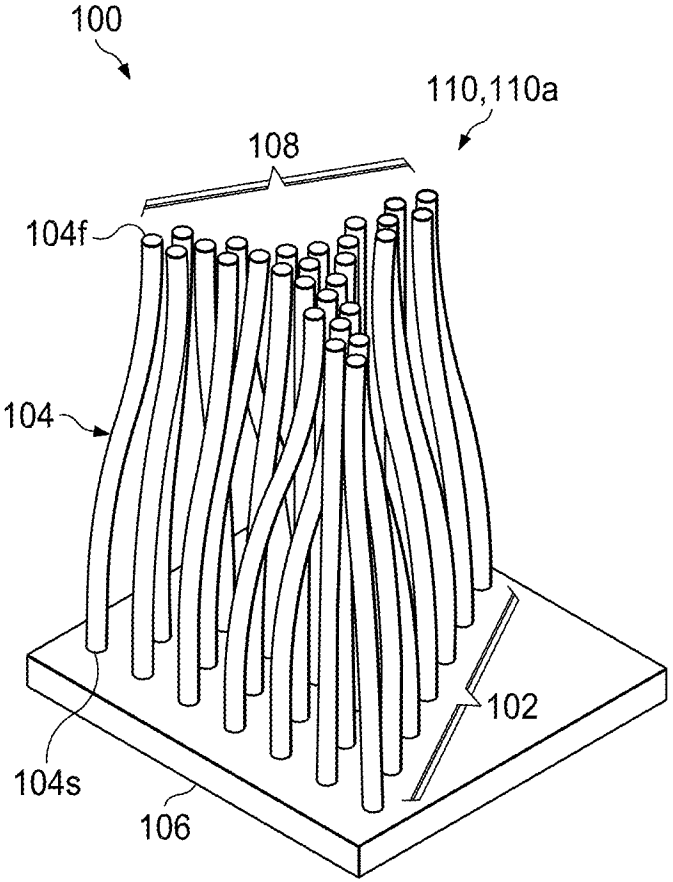
Figure 2D:
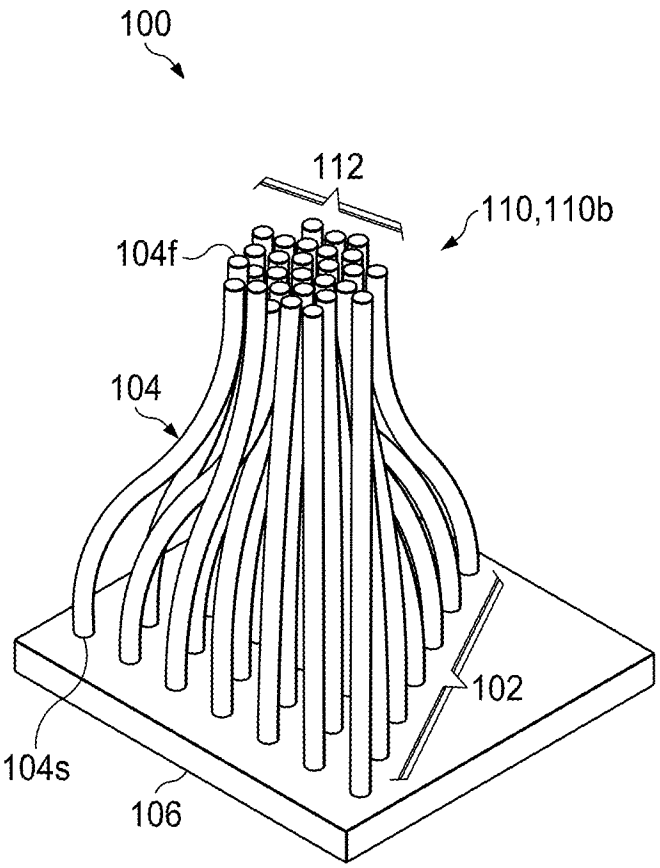

An array 102 of hair-like fibers 104 is shown in the first bundled configuration 108 described above in FIG. 2A. In FIG. 2B, the array 102 is exposed to a liquid 114, which induces the free ends 104*f* of the hair-like fibers 104 to become unbundled. More specifically, the free ends 104*f* of the hair-like fibers 104 may straighten and extend in a normal direction away from the substrate 106 during the exposure to the liquid 114. In this example, the array 102 is submerged in the liquid 114; alternatively, the array may be exposed to the liquid by spraying, pouring, or pumping the liquid (e.g., through one or more channels in the substrate), or by other methods. Preferably, the hair-like fibers 104 are fully immersed in the liquid 114 during the exposure. Any liquid having a non-zero surface energy may be used as long as the elastocapillary length $L_{EC}$ as defined below is not zero. Suitable liquids may include water, such as deionized water, aqueous solutions, organic solvents, organic solutions, oils, flowable waxes, flowable polymer precursors, dissolved polymers or flowable polymers.

Figure 2C:
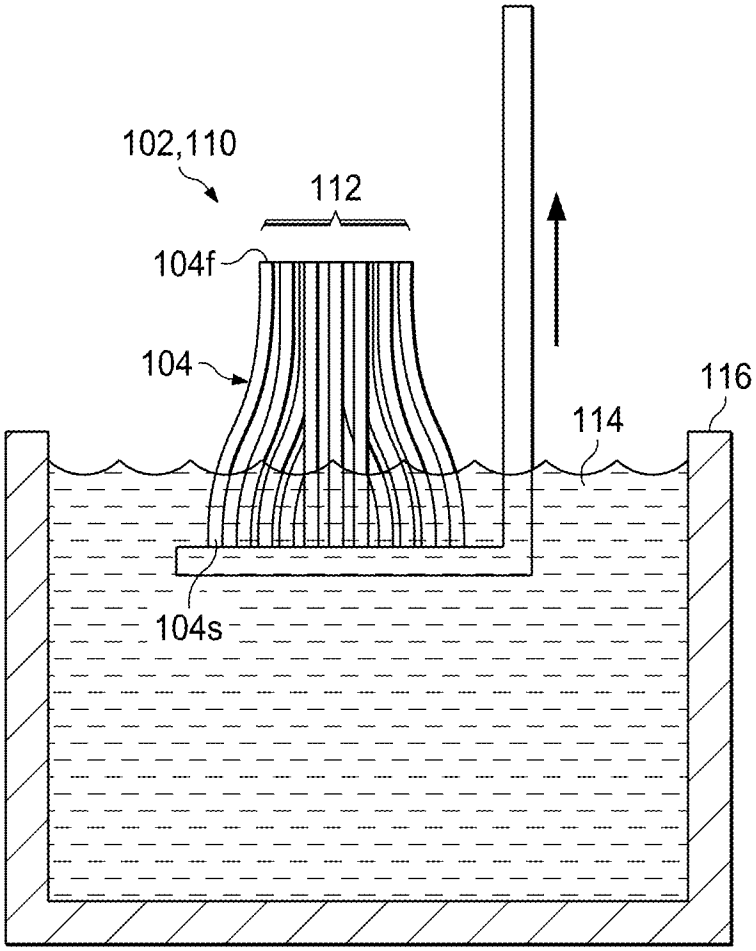

In FIG. 2C, the liquid 114 is removed from the array 102 at a predetermined removal rate. In this example, the array 102 is controllably extracted or withdrawn from a container 116 holding the liquid 114 to effect removal of the liquid 114. Alternatively, the liquid may be evaporated, drained, or withdrawn with a negative pressure (e.g., pumped), optionally through channel(s) in the substrate. Removal rates of the liquid may range from about 0.001 cm/s to about 100 cm/s. More typically, the removal rates lie in the range from about 0.01 cm/s to about 20 cm/s.

As the liquid 114 is removed, the free ends 104*f* of the hair-like fibers 104 assemble into a bundle 110 having a geometry and cross-sectional shape determined by the liquid removal rate. In this example, the second bundled configuration 112 described above is achieved, as shown in FIG. 2D. Alternatively, the first bundled configuration 108 or another bundled configuration may be obtained depending on the liquid removal rate.

The array 102 of hair-like fibers 104 may comprise a number of bundled configurations achievable through polymorphic texture reconfiguration, such as first, second, and/or $n^{th}$ bundled configurations (where n is an integer). In each bundled configuration, the free ends 104*f* of the fibers 104 form a bundle 110 having a unique geometry and cross-sectional shape. While n may be as high as 20, 50, or 100, practically speaking, n is typically 10 or less, or 5 or less. Typically, the array of hair-like fibers is reconfigurable into about 10 different bundled configurations or fewer, or about 5 different bundled configurations or fewer, by controlling the rate of liquid removal.

The polymorphic texture reconfiguration process is both repeatable and reversible. Returning to FIGS. 2A-2D, the method may further include, after removing the liquid 114 at a predetermined rate so as to arrive at the second bundled configuration 112, repeating the process. In other words, the array 102 may be re-exposed to the liquid 114, as shown in FIG. 2B, which induces the free ends 104*f* of the hair-like fibers 104 to become unbundled. The liquid 114 may then be removed at the same or a different predetermined removal rate, such that the free ends 104*f* of the hair-like fibers 104 are drawn together into a bundle 110 having a geometry dependent on the removal rate, thereby arriving at the first bundled configuration 108, the second bundled configuration 112, or another bundled configuration.

As would be recognized by the skilled artisan, the array 102 of hair-like fibers 104 is reconfigurable from any of the first through $(n-1)^{th}$ bundled configurations to the $n^{th}$ bundled configuration by exposure to and removal of a liquid at a predetermined rate. Similarly, the array of 102 hair-like fibers 104 may be reconfigured from the $n^{th}$ bundled configuration to any of the first through $(n-1)^{th}$ bundled configurations by exposure to and removal of a liquid at a predetermined rate.

The polymorphic self-assembly method may be carried out in a controlled environment, such as in a vacuum chamber or furnace, or under ambient conditions, such as at room temperature (20-25° C.) and atmospheric pressure.

The array 102 of hair-like fibers 104 may be dried after removal of the liquid 114. For example, after extracting the array 102 from the liquid 114, as shown in FIG. 2C, or after removing the liquid 114 in another way, the array 102 may be exposed to heat and/or flow of a gas (e.g., air) to promote complete drying of the hair-like fibers 104, thereby forming a dried array. Due to van der Waals forces, the dried array may retain the bundled configuration (e.g., first, second or $n^{th}$ bundled configuration) for an extended time period (e.g., months) under ambient conditions.

In some cases, one or more (or all) of the hair-like fibers 104 may comprise a plurality of smaller-diameter fibers, or fibrils. In other words, each hair-like fiber 104 may be a single fiber or may include multiple fibrils. It is understood that the term "fibrils" may replace "hair-like fibers" throughout this disclosure in examples in which one or more of the hair-like fibers includes a plurality of fibrils. The hair-like fibers 104 may be uniformly or nonuniformly spaced apart within the array 102. The spacing between adjacent hair-like fibers 104 on the substrate 106 is typically in a range from about 10 nm to about 10 mm but may have any value as long as the spacing is smaller than the length of the fibers 104.

While the hair-like fibers 104 may be described as being "on" the substrate 106, it is understood that this description does not limit the secured ends 104*s* of the hair-like fibers 104 to locations literally on top of the substrate 106. For example, the hair-like fibers 104 may protrude from holes or channels extending into or through the thickness of the substrate 106, where the secured ends 104*s* may be attached to channel walls (as opposed to a top surface of the substrate 106). Regardless, hair-like fibers 104 that are attached to or integrally formed with the substrate 106 may be understood to be "on" the substrate 106, and an array 102 of such fibers 104 is understood to be "on" the substrate 106.

The hair-like fibers (and/or fibrils) 104 may comprise any of a number of synthetic or natural materials, which may be selected depending on the intended use of the device. For example, the hair-like fibers 104 may comprise a material such as a polymer, metal, semiconductor, ceramic, and/or carbon. Similarly, the substrate 106 may comprise any of a range of synthetic or natural materials, such as a polymer, metal, semiconductor, ceramic, and/or carbon. The substrate 106 and the hair-like fibers 104 may comprise the same or a different material. The hair-like fibers 104 may exhibit any of a range of properties, such as high electrical and/or thermal conductivity, magnetic behavior, and/or a high stiffness. The substrate 106 may be rigid or flexible.

To ensure that reconfiguration can be achieved, the hair-like fibers 104 may have a length of at least about $L_{EC}$, as defined below. Typically, the length of the fibers may may lie in a range from about 0.1 micron to about 10 cm. As would be recognized by the skilled artisan, any fibrils that make-up the hair-like fibers may have the same length requirement. Each of the hair-like fibers may have a width or diameter in a range from about 1 nm to about 500 microns. The width or diameter may also lie in the range from about 1 nm to about 200 microns. When the hair-like fiber is made up of multiple fibrils, the width or diameter described above refers to a collective width or diameter of the multiple fibrils.

It is contemplated that the device may include a plurality of the arrays (e.g., a group of arrays) of hair-like fibers on the substrate. In such a case, the free ends of the hair-like fibers from one array may bundle together with the free ends of the hair-like fibers from the same array and/or from one or more adjacent arrays, forming what may be described as interconnected bundles or cellular structures, as discussed in the Examples. Such interconnected bundles or cellular structures may be reconfigured as described above using polymorphic self-assembly, such that a device may include first, second, and/or $n^{th}$ cellular configurations, where, in each cellular configuration, the interconnected bundles may have a unique geometry and cross-sectional shape.

The polymorphic self-assembly process is reversible and repeatable for both individual arrays and groups of arrays. For example, a group of arrays of hair-like fibers is reconfigurable from any of the first through $(n-1)^{th}$ cellular configurations to the $n^{th}$ cellular configuration by exposure to and removal of a liquid at a predetermined rate. Similarly, the group of arrays is reconfigurable from the $n^{th}$ cellular configuration to any of the first through $(n-1)^{th}$ cellular configurations by exposure to and removal of a liquid at a predetermined rate. As above, n may be as high as 20, 50, or 100, but practically speaking, n is typically 10 or less, or 5 or less.

Examples of devices that may utilize the above-described reconfigurable arrays of hair-like fibers include tunable antennas, flow-altering airfoils, and variable friction brushes. A tunable antenna comprising an array of the hair-like fibers may be able to receive and/or transmit signals within a first frequency range while the array is in a first bundled configuration, and within a second frequency range while the array is in a second bundled configuration. A flow-altering airfoil comprising an array of the hair-like fibers may induce a first type of aerodynamic flow while the array is a first bundled configuration, and a second type of aerodynamic flow while the array is in a second bundled configuration. A variable friction brush comprising an array of the hair-like fibers may exhibit a first set of frictional and/or stiffness properties while the array is in a first bundled configuration, and a second set of frictional and/or stiffness properties while the array is in a second bundled configuration. The above-described devices may comprise single arrays or groups of arrays, which have the reconfigurability described above.

Phenomenon of Elastocapillarity

Figure 3:
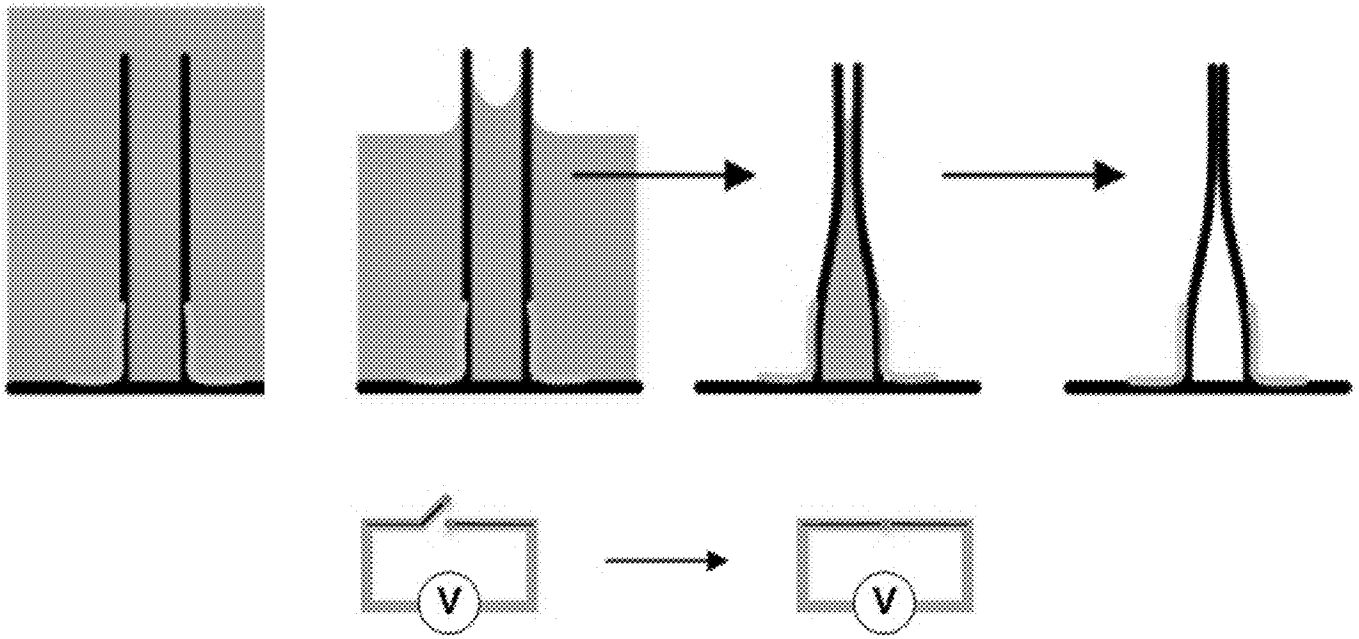
FIG. 3 illustrates the principle of hair bending and self-assembly by elastocapillarity in reference to a simple system including two vertical hair-like fibers.

The principle of hair bending and aggregation by elastocapillarity may be understood in reference to FIG. 3, which shows a simple system including two vertical hair-like fibers, with a metal electrode at the base of each fiber. The hair-like fibers are straight when submerged in liquid, but they cannot remain straight when the liquid recedes due to the high surface energy of the liquid film surrounding the fibers. Consequently, the hair-like fibers bend and aggregate by the forces of the meniscus, and remain bent when dry due to surface adhesion. The straight hair-like fibers, whether in the wet or dry state, are not in contact, and hence may not conduct electricity. However, once the hair-like fibers bend and aggregate, forming a bundled configuration, they close the circuit and form a conductive path.

Elastocapillarity may be understood as the balance between the bending energy of the hair-like fibers and the capillary forces of a liquid. When the liquid recedes from the two hair-like fibers, one can consider the situation where the liquid forms a conformal film having a surface energy of $2\gamma\pi rl$ around the hair-like fibers, where $\gamma$ is the surface energy in $J/m^2$ and r and l are the radius and length of the hair-like fibers, respectively. The meniscus between the hair-like fibers, on the other hand, can draw the fibers together. This leads to the possibility of another stable configuration where the liquid surface energy is minimized due to the elimination of the internal interface between the hair-like fibers, while some elastic strain energy is stored in the bending of the hair-like fibers. The elastic energy scales with $\sim EI(d/l)^{3/2}$, where E is the Young's Modulus of the hair-like fibers, I is the moment of area and d is the spacing between the hair-like fibers. The length scale governing this reconfiguration is called elastocapillary length and can be defined as $L_{EC}=\sqrt{Er^3/\gamma}$, where $1/L_{EC}$ is the curvature that surface tension forces may induce to the flexible hair-like fibers. One can establish then the condition for bundling of free ends of the hair-like fibers by considering when the curvature $d/L^2$ is smaller than $1/L_{EC}$, in other words, $L>L_{min}\sim\sqrt{L_{EC}d}$.

EXAMPLES

The rate-dependent polymorphic transformation of a triangular array of hair-like fibers is investigated. The samples in each of these experiments include vertical hair-like fibers organized into a two-dimensional array having a triangular cross-sectional geometry. The hair-like fibers comprise commercially available carbon fiber tows inserted into and attached to precut holes in an acrylic substrate. Acrylic glue is used to secure the hairs to the substrate. The samples are fixed on a vertically moving stage such that the free ends of the hair-like fibers are directed upwards. The moving stage submerges the samples in a liquid-filled container and then removes them from the liquid. The free ends of the hair-like fibers pierce the liquid interface as they are removed without buckling. The equilibrium between the self-directed surface forces of the liquid and the strain energy of the hair-like fibers dictates the final bundled configuration.

Figure 4A:
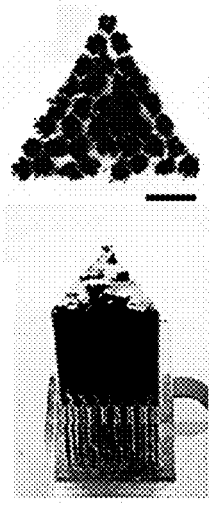
FIG. 4A includes optical images showing top and side views of an exemplary triangular array of carbon fibers, where the scale bar is 2 mm.
Figure 4B:
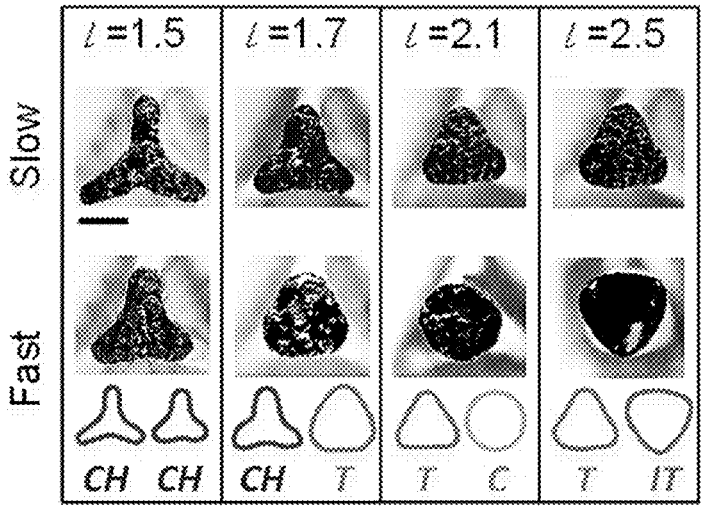
FIG. 4B shows bundled configurations of the array of carbon fibers of FIG. 4A after removal of the liquid, where each column illustrates how the polymorphic texture reconfiguration depends on the length of the fibers, and where each row shows the dependence of the reconfiguration on removal rate. The bottom schematics trace the cross-sectional changes for slow and fast drainage rates.
Figure 4C:
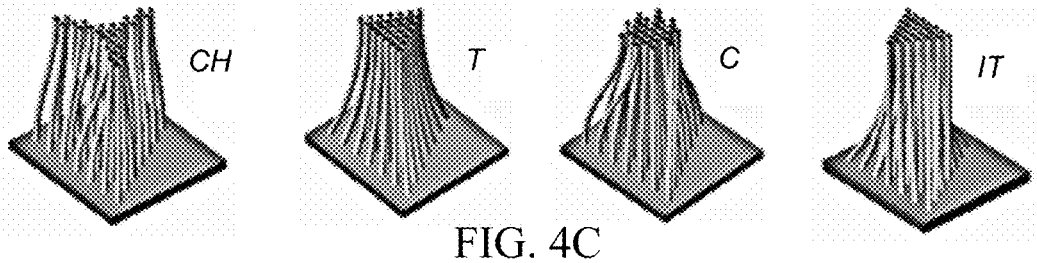
FIG. 4C shows three-dimensional views of the bundles having the cross-sectional shapes shown in FIG. 4B.
Figure 4D:
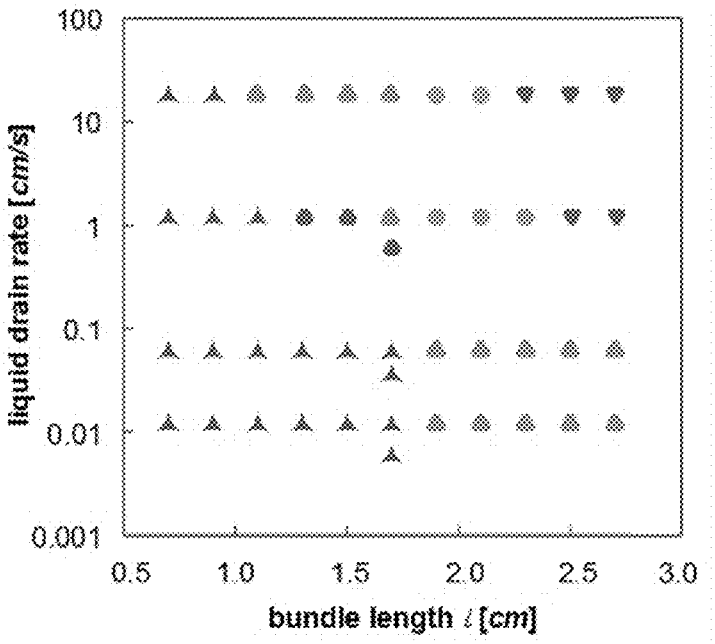
FIG. 4D is an experimental mode plot of the shapes obtained as a function of fiber lengths and drainage (liquid removal) rates.

Surprisingly, it has been found that when the liquid is drained at higher rates, the free ends of the hair-like fibers can re-organize into five bundled configurations having distinct cross-sectional shapes, including what may be described as concave hexagons (CH), triangles (T), circles (C), three-lobed clubs (CL) and, unexpectedly, inverted triangles (IT), as shown in FIGS. 4A-4D. The optical images of FIG. 4A show top and side views of a triangular array of carbon fibers, where the scale bar is 2 mm. The optical images of FIG. 4B show bundled configurations of the array of carbon fibers after removal of the liquid, where each column illustrates how the polymorphic texture reconfiguration depends on the length (l, cm) of the fibers, and where each row shows the dependence of the reconfiguration on removal rate ("slow" or 0.018 cm/s, and "fast" or 18 cm/s). The bottom schematics trace the cross-sectional changes for slow and fast drainage rates, where the observed shapes are labeled as indicated above, and shown in three-dimensions in FIG. 4C. For l=2.5 cm and the fast drainage (liquid removal) rate, the original triangular array cross-section inverts such that the corners become less curved than the originally straight edges. FIG. 4D is an experimental mode plot of the shapes obtained as a function of fiber lengths and drainage (liquid removal) rates.

Due to the number of hair-like fibers in each bundled configuration (~165,000 in this example), in principle there exists a multitude of self-organized geometries exhibiting static equilibrium between the bending and surface energies. These geometries may be referred to as elastocapillary mode shapes. Each mode shape, while being in static equilibrium, has a different total strain and surface energy, where the lowest total energy is obtained at a slow liquid removal rate.

Figure 5:
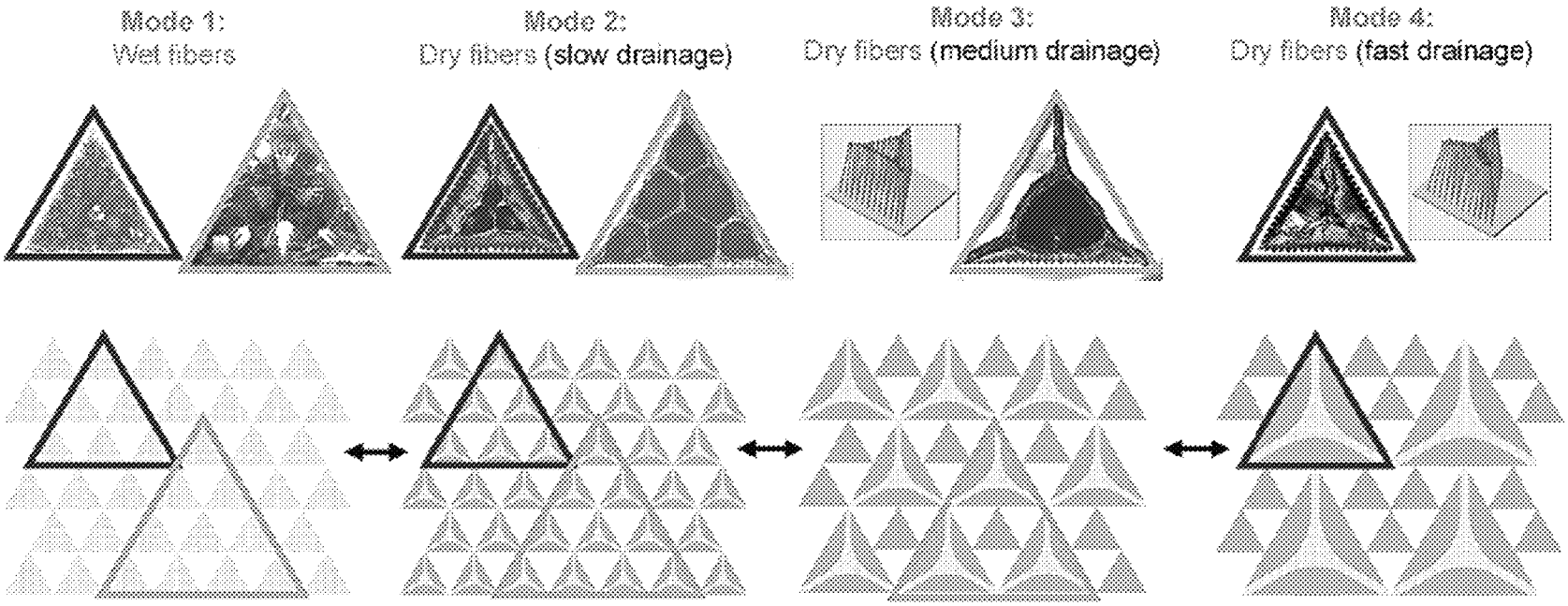
FIG. 5 shows preliminary experimental results of groups of arrays of hair-like fibers that are reconfigured into interconnected bundles or cellular structures of various sizes and morphologies upon exposure to a liquid and removal of the liquid at different rates.

FIG. 5 shows preliminary experimental results of groups of arrays of hair-like fibers that may be reconfigured into cellular structures of various sizes and morphologies upon exposure to a liquid and removal of the liquid at different rates. The hair-like fibers are initially arranged into adjacent triangular arrays as shown on the bottom left (Mode 1). After exposure to and removal of liquid at various rates, as indicated, the groups of arrays re-arrange into various geometries or cellular structures, which are illustrated on the right (Modes 2-4). Higher liquid removal rates are associated with larger cluster or cell sizes. At the top of the figure are optical photographs from preliminary experiments with vertically oriented carbon fibers showing actual changes in the fiber assembly. All images with a light gray frame are from the same arrays of hair-like fibers immersed in liquid and retracted at different rates. The images in with the dark gray frame are from the same arrays of hair-like fibers immersed in liquid and retracted at different rates. The difference between the two is the number of triangular clusters per sample.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A fiber-based device having a reconfigurable geometry, the fiber-based device comprising:

an array of fibers spaced apart on a substrate including one or more channels, each fiber comprising a free end extending away from the substrate and a secured end attached to the substrate, the array comprising:

a first bundled configuration where the free ends of the fibers are drawn together into a bundle having a first cross-sectional shape, and a second bundled configuration where the free ends of the fibers are drawn together into a bundle having a second cross-sectional shape, wherein the array of fibers is reconfigurable from the first bundled configuration to the second bundled configuration by exposure to a liquid and then removal of the liquid at a predetermined rate through the one or more channels.

2. The fiber-based device of claim 1 being selected from a tunable antenna, a flow-altering airfoil, and a variable friction brush.

3. The fiber-based device of claim 1, wherein the fibers are physically or chemically bonded to the substrate.

4. The fiber-based device of claim 1, wherein the fibers are integrally formed with the substrate.

5. The fiber-based device of claim 1, wherein the fibers comprise a material selected from the group consisting of: carbon, polymer, metal, semiconductor, and ceramic.

6. The fiber-based device of claim 1, wherein one or more of the fibers comprises a plurality of fibrils.

7. The fiber-based device of claim 1, wherein each of the fibers has a length at least as long as $L_{EC}$, where $L_{EC}=\sqrt{Er^3/\gamma}$, and where E is fiber Young's modulus, r is fiber radius, and $\gamma$ is liquid surface energy.

8. The fiber-based device of claim 1, wherein each of the fibers has length in a range from about 0.1 cm to about 10 cm.

9. The fiber-based device of claim 1, wherein each of the fibers has a width or diameter in a range from about 1 micron to about 500 microns.

10. The fiber-based device of claim 9, wherein the width or diameter is in the range from about 5 microns to about 200 microns.

11. The fiber-based device of claim 1, wherein the fibers are uniformly spaced apart within the array.

12. The fiber-based device of claim 1, wherein a spacing between adjacent fibers on the substrate is in a range from about 10 nm to about 10 mm.

13. The fiber-based device of claim 1, wherein the array is a one- or two-dimensional array having a shape selected from the group consisting of: line, circle, triangle, square, rectangle, parallelogram, pentagon, hexagon, octagon, and irregular shape.

14. The fiber-based device of claim 1, wherein each of the first cross-sectional shape and the second cross-sectional shape is selected the group consisting of: concave hexagon, triangle, circle, three-lobed club, and inverted triangle.

15. The fiber-based device of claim 1, further comprising an $n^{th}$ bundled configuration, where n is an integer greater than 2, wherein the array of fibers is reconfigurable from any of the first through $(n-1)^{th}$ bundled configurations to the $n^{th}$ bundled configuration, or from the $n^{th}$ bundled configuration to any of the first through $(n-1)^{th}$ bundled configurations, by immersion in a liquid and then removal of the liquid at a predetermined rate.

16. The fiber-based device of claim 1, further comprising a group of the arrays on the substrate, wherein the group comprises:

a first cellular configuration where the free ends of the fibers from a selected array are bundled with the free ends of the fibers from one or more adjacent arrays into an interconnected bundle having a first geometry, and a second cellular configuration where the free ends of the fibers from a given array are bundled with the free ends of the fibers from one or more adjacent arrays into an interconnected bundle having a second geometry, wherein the first cellular configuration is reconfigurable to the second cellular configuration by exposing the group of the arrays to a liquid and then removing the liquid at a predetermined rate.

17. A method of reconfiguring the geometry of a fiber-based device, the method comprising:

providing an array of fibers spaced apart on a substrate, each fiber comprising a free end extending away from the substrate and a secured end attached to the substrate;

submerging the array of fibers in a liquid, the secured ends of the fibers contacting the liquid before the free ends of the fibers as the array is submerged; and removing the liquid at a predetermined removal rate, the free ends of the fibers being drawn into a bundle to form a bundled configuration of the array as the liquid is removed in a direction toward the substrate, where the bundle has a cross-sectional shape dependent on the removal rate of the liquid.

18. The method of claim 17, wherein removing the liquid comprises withdrawing the array from the liquid, evaporating the liquid, draining the liquid, and/or evacuating the liquid.

19. The method of claim 17, wherein the liquid is selected from the group consisting of: water, organic solvents, oils, flowable waxes, flowable polymer precursors, or flowable polymers.

20. The method of claim 19, wherein the bundled configuration is a first bundled configuration, and the bundle has a first cross-sectional shape, and further comprising, after removing the liquid, re-exposing the array of fibers to the liquid, the free ends of the fibers becoming unbundled during the exposure, and removing the liquid at the same or a different removal rate, the free ends of the fibers being drawn into a bundle as the liquid is removed to form a second bundled configuration of the array, wherein the second bundled configuration has a cross-sectional shape dependent on the removal rate of the liquid.

21. The method of claim 17, wherein the free ends of the fibers straighten and extend in a normal direction away from the substrate while the array is submerged in the liquid.

22. The method of claim 17, further comprising, after removing the liquid, exposing the array to heat and/or a flow of a gas to promote complete drying of the fibers.

* * * * *